US005566819A

United States Patent [19]

Lustgarten et al.

[11] Patent Number: 5,566,819

[45] Date of Patent: Oct. 22, 1996

[54] PUSH BUTTON SWITCH WITH OVER CENTER BRIDGE

[75] Inventors: James R. Lustgarten, Chesterton; John A. Stuhlmacher, Crown Point; Jon Kretzmann; Elmer Martin, both of Valparaiso, all of Ind.

[73] Assignee: McGill Manufacturing Company, Inc., Valparaiso, Ind.

[21] Appl. No.: 430,301

[22] Filed: Apr. 28, 1995

Related U.S. Application Data

[63] Continuation of Ser. No. 149,282, Nov. 9, 1993, abandoned.

[51] Int. Cl.[6] ..... H01H 5/18

[52] U.S. Cl. ..... 200/407; 200/452; 200/535

[58] Field of Search ..... 200/407, 408, 200/462, 454, 452, 460, 534, 535

[56] References Cited

U.S. PATENT DOCUMENTS

| | | | |
|---|---|---|---|
| 2,789,173 | 4/1957 | Kaminky | 200/407 |
| 3,348,010 | 10/1967 | Johnson | 200/437 X |
| 3,412,225 | 11/1968 | Rogers et al. | 200/452 |
| 3,999,024 | 12/1976 | Marquardt | 200/437 |

FOREIGN PATENT DOCUMENTS

| | | | |
|---|---|---|---|
| 2142887 | 9/1980 | Germany | 200/465 |
| 3402080 | 7/1985 | Germany | 200/434 |

*Primary Examiner*—Renee S. Luebke
*Attorney, Agent, or Firm*—Leydig, Voit & Mayer, Ltd.

[57] ABSTRACT

A resilient bridge of a snap-action switch is normally held in an unactuated position by virtue of one end portion of the bridge bearing against a lobe formed integrally with a manually actuatable and linearly movable plunger. When the plunger is manually depressed toward an actuated position against the bias of a return spring, the lobe moves away from the end portion of the bridge. As an incident thereto, the bridge changes the state of the switch by automatically snapping over center along a path extending transversely of the path followed by the plunger.

8 Claims, 2 Drawing Sheets

PUSH BUTTON SWITCH WITH OVER CENTER BRIDGE

This is a continuation of application Ser. No. 08/149,282 filed on Nov. 9, 1993 and now abandoned.

BACKGROUND OF THE INVENTION

This invention relates to a push button switch of the type having a manually operable actuator normally held in an unactuated position by a spring and adapted to be shifted linearly along a predetermined path to an actuated position when moved manually. More particularly, the invention relates to a switch of the foregoing type in which movement of the actuator from its normal unactuated position to its actuated position causes a conductive bridge to snap over center and either establish or break an electrical circuit between two terminals of the switch. In snapping over center, the bridge moves in a path which extends generally transversely of the path followed by the actuator.

In prior switches of this type, a cam separate from the actuator has been necessary to convert the motion of the actuator along one path to movement of the bridge along a generally transversely extending path. The need to separately manufacture and assemble the cam adds to the cost and complexity of the switch.

SUMMARY OF THE INVENTION

The general aim of the present invention is to provide a switch which is of simpler and less expensive construction than prior switches of the same general type.

A more detailed object of the invention is to achieve the foregoing by providing a switch having a bridge which snaps over center automatically as an incident to the actuator being shifted to its actuated position and without need of the actuator exerting any force on the bridge, either directly or through an intermediate cam or the like.

The invention also resides in the unique positioning of a fulcrum for the bridge to enable the bridge to snap over center automatically upon shifting of the actuator to its actuated position.

These and other objects and advantages of the invention will become more apparent from the following detailed description when taken in conjunction with the accompanying drawings.

Figure 1:
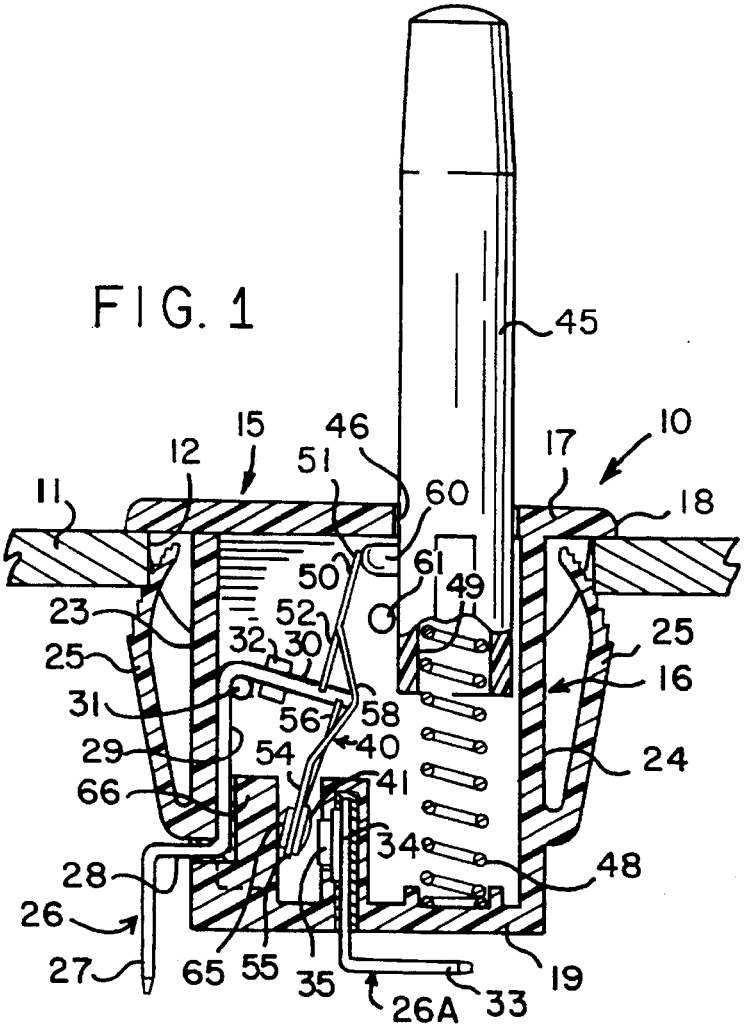
FIG. 1 is a cross-sectional view taken vertically through a new and improved switch incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the present invention has been shown in the drawings as embodied in an electrical switch 10 for making or breaking a circuit or circuits to one or more electrical utilization devices (not shown). The specific switch which has been shown is a normally open switch in that, when the switch is actuated manually from its normal condition, it makes or closes an electrical circuit. It should be appreciated, however, that the principles of the invention are also applicable to a normally closed switch which breaks a circuit upon being actuated and to a double throw switch which closes one circuit when the switch is in an unactuated state and another circuit when the switch is in an actuated state.

In the present instance, the switch 10 has been shown in conjunction with a mounting panel or plate 11 which is formed with a rectangular opening 12. The switch includes a housing 15 which is defined by a hollow plastic body 16 and by a plastic cap 17. The lower portion of the housing is of rectangular cross-section and is telescoped into the opening 12 while the upper portion of the housing is formed with a peripheral flange 18 for engaging the upper side of the plate 11 around the margins of the opening 12 to prevent the housing 15 from moving inwardly through the opening.

The housing 15 includes a bottom wall 19, two opposing side wall 20 and 21 (FIG. 4), and two opposing end walls 23 and 24 located at the ends of and extending perpendicular to the side walls. Two laterally spaced and cantilevered fingers 25 are molded integrally with and are hinged to the lower end portion of each end wall and are adapted to pass through the opening 12 during insertion of the housing 15 into the opening. Just after such insertion, the fingers spring outwardly and engage the lower portion of the edge of the opening so as to attach the housing releasably to the plate 11.

Two electrical terminals 26 and 26A made of electrically conductive metal are supported by the body 16 of the housing 15. The first terminal 26 includes a downwardly projecting section 27 adapted to be connected to a utilization circuit, a horizontal section 28 extending inwardly through the end wall 23, a vertical section 29 extending upwardly along the inner side of the end wall 23, and an elongated section 30 extending from the end wall 23 toward the end wall 24. Pins 31 molded integrally with the side walls 20 and 21 support the junction between the sections 29 and 30 while lugs 32 molded integrally with the side walls support the section 30 to prevent any substantial flexing of that section.

The terminal 26A is generally L-shaped and includes a horizontal leg 33 adapted for connection to the electrical circuit. A vertical leg 34 extends upwardly from the horizontal leg and through the bottom wall 19 of the body 16, there being a contact button 35 on one side of the vertical leg.

A spring metal bridge 40 (to be described in detail subsequently) is located in the housing 15, is connected electrically to the terminal 26 and includes a lower end portion which carries a contact 41. Normally, the bridge 40 is located in an unactuated position shown in FIG. 1 in which, in the present switch 10, the contact 41 is spaced from the contact 35 so as to place the switch in an open state and interrupt a circuit between the terminals 26 and 26A. When the switch is manually actuated, the bridge 40 moves to the actuated position shown in FIGS. 2 and 3 in order to bring the contact 41 into engagement with the contact 35 and establish a circuit between the terminals.

Figure 2:
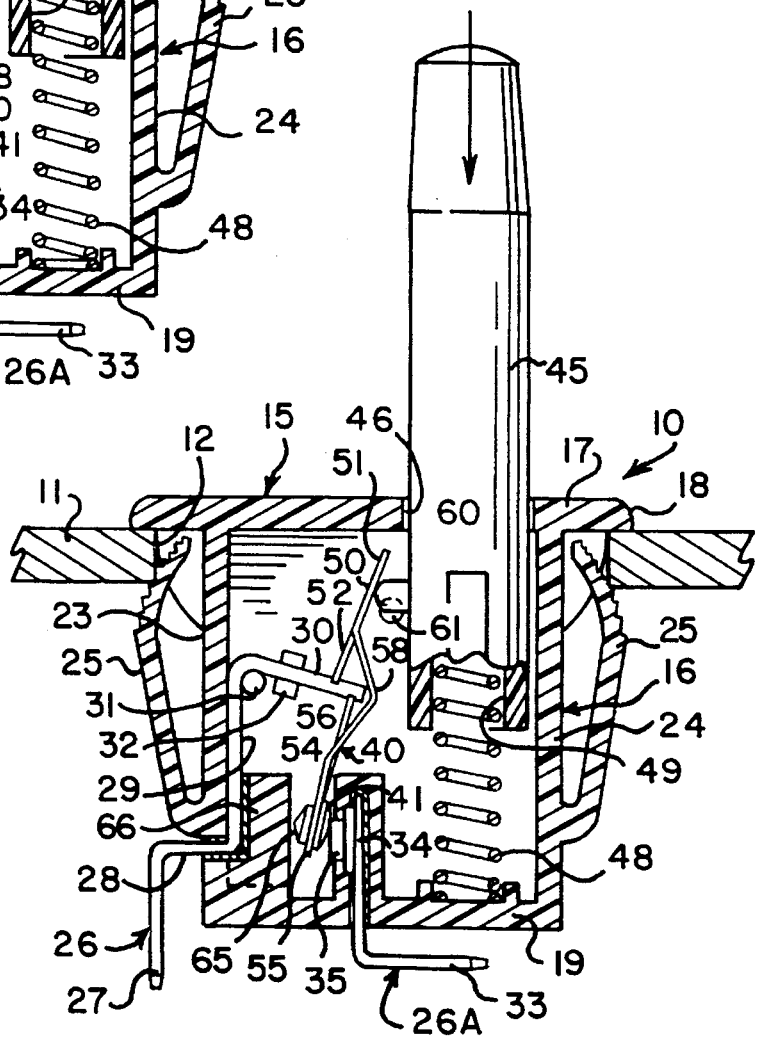
FIGS. 2 and 3 are views similar to FIG. 1 but show successively moved positions of certain components of the switch, FIG. 3 being on an enlarged scale.
Figure 3:
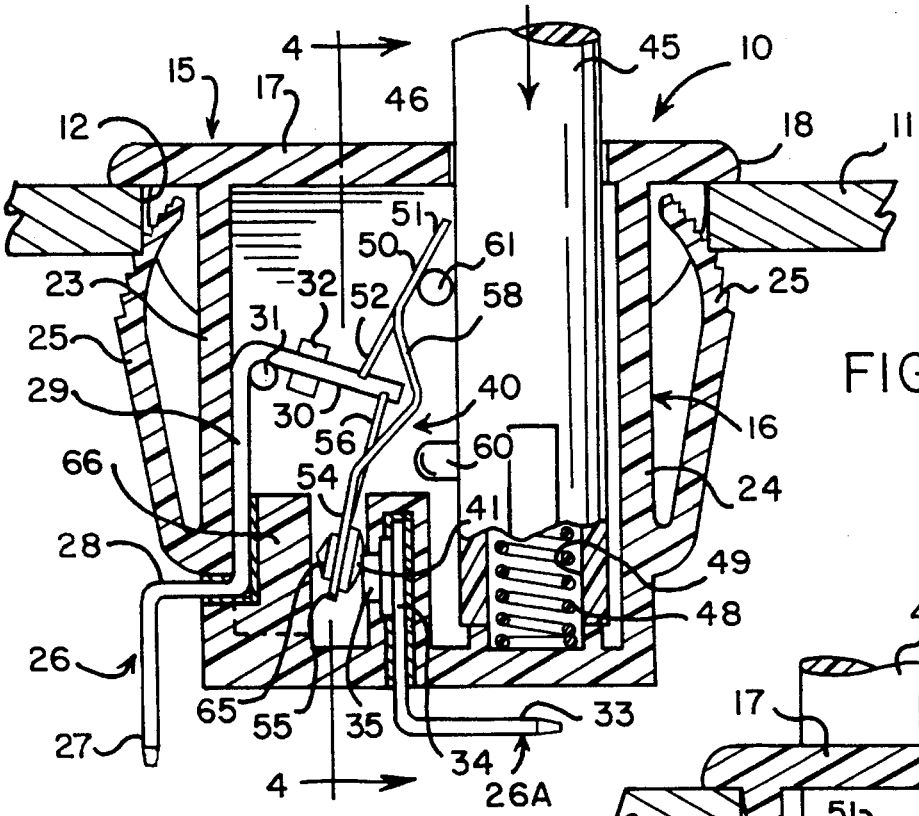

Movement of the bridge 40 between its unactuated position of FIG. 1 and its actuated position of FIGS. 2 and 3 is effected in response to downward and upward movement of a manually operable switch actuator 45. Herein, the actuator is in the form of an elongated cylindrical plunger which is received slidably in a hole 46 in the cap 17. Coacting means (not shown) on the plunger 45 and the inner sides of the side walls 20 and 21 coact with the hole 46 to guide the plunger for linear movement along a vertical path and also to prevent the plunger from rotating about a vertical axis.

A coil spring 48 is telescoped into a socket 49 in the lower end of the plunger and is compressed between the plunger and the bottom wall 19 of the body 16. The spring urges the plunger upwardly to a normal unactuated position shown in FIG. 1 but yields to permit downward movement of the plunger to an actuated position (FIGS. 2 and 3) when the plunger is depressed manually.

In accordance with the present invention, the bridge 40 and the plunger 45 coact such that the plunger normally exerts a force on the bridge to hold the bridge in its unactuated position shown in FIG. 1. When the plunger is moved downwardly toward its actuated position, the force on the bridge is removed so as to enable the bridge to automatically snap over center to its actuated position along a path extending generally transversely of the path followed by the plunger. With this arrangement, the need for moving the bridge to its actuated position with a cam or other member separate from the plunger is eliminated so as to reduce the complexity and cost of the switch 10.

Figure 4:
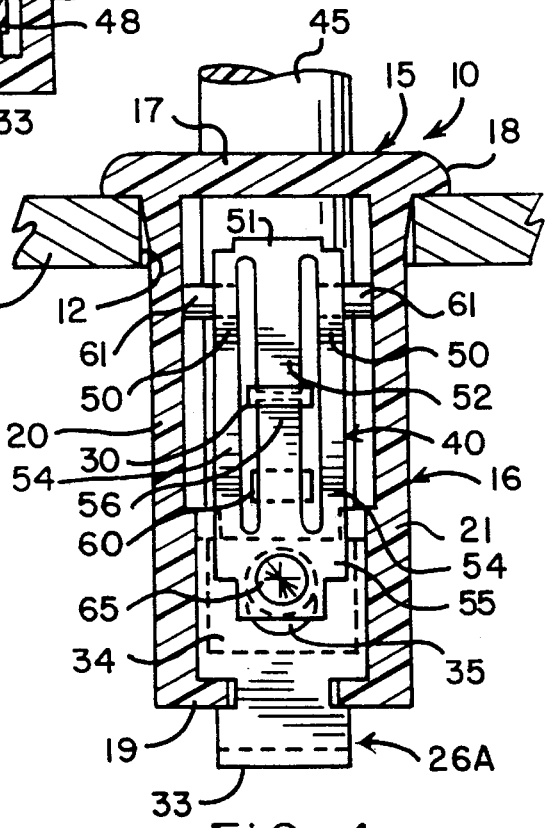
FIG. 4 is a fragmentary cross-section taken substantially along the line 4—4 of FIG. 3.
Figure 5:
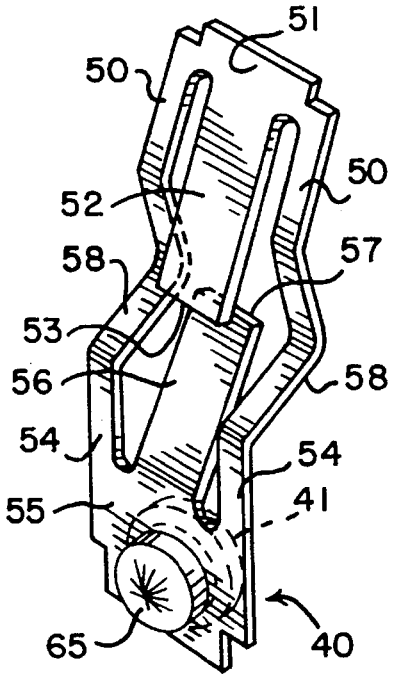
FIG. 5 is a perspective view of the bridge of the switch.

The bridge 40 is shown in detail in FIGS. 3–5 and is formed by an elongated strip of spring metal. The bridge includes an upper end portion defined by two laterally spaced legs 50 whose upper end portions are joined by a laterally extending crosspiece 51. Depending from the crosspiece 51 and located between the legs 50 is an elongated tongue 52 having a lower free edge 53 located near the longitudinal center of the bridge. The tongue 52 is disposed generally in the same plane as the legs 50.

As shown most clearly in FIG. 4, the lower end portion of the bridge 40 is generally similar to the upper end portion thereof. Thus, the lower end portion of the bridge is formed by two laterally spaced legs 54 having lower end portions connected by a crosspiece 55 which carries the contact 41. An elongated tongue 56 projects upwardly from the crosspiece 55 and includes an upper free edge 57 spaced just a short distance below the lower edge 53 of the tongue 52. The tongue 56 is bent away from the legs 54 and toward the plunger 45 and thus lies in a plane which is offset slightly from the plane occupied by the legs 54.

The bridge 40 is completed by two laterally spaced bowed sections 58 which are generally V-shaped and which join the lower ends of the legs 50 to the upper ends of the legs 54. The sections 58 generally straddle the tongues 52 and 56 and are bowed in such a direction that the apex of each V is offset from the tongues toward the plunger and points toward the plunger.

In carrying out the invention, the elongated section 30 of the terminal 26 is inclined at an acute angle relative to the plunger 45 and serves as a fulcrum for the bridge 40. In this specific instance, the elongated section 30 of the terminal 26 is inclined downwardly relative to horizontal at an angle A (FIG. 3) of about 15 degrees. Near its free end, the elongated section 30 is formed with an upwardly opening notch which receives the edge 53 of the upper tongue 52. A downwardly opening notch is formed in the elongated section 30 even nearer to the free end thereof and serves as a seat for the edge 57 of the lower tongue 56. The bridge 40 is held in assembled relation with the elongated section 30 of the terminal 26 by virtue of the tongues being resiliently stressed and frictionally engaging the edges of the notches. The fulcrum for the overall bridge is located along the section 30 approximately midway between the two tongues.

Normally, the bridge 40 is held in its unactuated position shown in FIG. 1 by means which, pursuant to the invention, are joined rigidly to and preferably are formed integrally with the plunger 45. Herein, these means simply comprise a projection in the form of a short lobe 60 which is molded integrally with and extends radially from the plunger near the lower end thereof. The lobe 60 is generally rectangular in cross-section and is formed with a rounded nose. The lobe 60 projects toward the bridge 40 and, when the plunger 45 is in its normal unactuated position, engages the upper crosspiece 51 of the bridge (see FIG. 1). It will be noted that the elongated section 30 of the terminal 26 is inclined in such a direction as to diverge away from the lobe 60 when the plunger 45 is in its normal position and as the elongated section progresses toward the plunger.

Two aligned lugs 61 are molded integrally with and project inwardly from the side walls 20 and 21 adjacent that side of the plunger 45 that carries the lobe 60. The opposing ends of the lugs 61 are spaced laterally from one another and define a gap through which the lobe passes as the plunger is moved between its unactuated and actuated positions. When the plunger is in its fully actuated position, the upper legs 50 of the bridge 40 engage the lugs 61 and limit movement of the bridge beyond the position shown in FIG. 3 in order to prevent the crosspiece 51 from scraping against the plunger 45.

FIG. 1 shows the components of the switch 10 as positioned when the switch is in its normal or unactuated state. As illustrated, the spring 48 forces the plunger 45 upwardly to a fully retracted position in which the lobe 60 is located near the cap 17 of the housing 15. The bridge 40 is positioned with the upper crosspiece 51 in engagement with the lobe 60, with the contact 41 spaced from the contact 35 and with a button 65 on the side of the lower crosspiece 55 opposite the contact 41 in engagement with an internal stop 66 projecting upwardly from the bottom wall 19 of the body 16. The V-shaped sections 58 of the bridge 40 are located closely adjacent the free edge of the elongated section 30 of the terminal 26.

When the bridge 40 is positioned as shown in FIG. 1, a straight line extending from the point of contact of the upper crosspiece 51 and the lobe 60 to the lower crosspiece 55 lies to the left of the fulcrum defined on the terminal section 30 midway between the two tongues 52 and 56. As a result, the bridge is held in a condition with the upper crosspiece 51 being biased clockwise into engagement with the lobe 60 and with the lower crosspiece 55 also being biased clockwise and pressing the button 65 against the stop 66. Accordingly, the contact 41 is positively biased out of engagement with the contact 35.

As the plunger 45 is depressed manually, the lobe 60 shifts downwardly and linearly away from the upper crosspiece 51 of the bridge 40. After the lobe has moved downwardly through just a short distance, the upper crosspiece 51 swings clockwise to a position in which a straight line extending from the point of contact of the crosspiece with the lobe to the lower crosspiece 55 lies to the right of the aforementioned fulcrum. As a result, the bridge snaps over center with a spring action to swing the lower crosspiece 55 and the contact 41 in a counterclockwise direction and to resiliently bias the contact 41 into engagement with the contact 35 as shown in FIG. 2. As the bridge snaps over center, the bowed sections 58 of the bridge flex away from the free end of the elongated section 30 of the terminal 26.

Upon further depression of the plunger 45, the lobe 60 moves downwardly out of engagement with the upper crosspiece 51 of the bridge 40, and the bridge continues to snap over center until the upper legs 50 of the bridge engage and stop against the lugs 61 (see FIG. 3). In this position of the bridge, the contact 41 is biased into engagement with the contact 35 by spring force of significant magnitude so as to establish good electrical conduction between the two contacts.

When the plunger 45 is manually released, the spring 48 forces the plunger and the lobe 60 upwardly toward the normal position of FIG. 1. As the lobe travels upwardly, it wipes against the upper crosspiece 51 to move the latter counterclockwise until the bridge 40 snaps reversely over center and brings the button 65 into engagement with the stop 66.

From the foregoing, it will be apparent that the present invention brings to the art a new and improved switch 10 in which the bridge 40 is fulcrumed on an angled section 30 of the terminal 26 and is positioned to snap over center to the closed state of the switch along a path extending generally transversely of the path of movement of the plunger 45. The bridge automatically snaps over center as the simple lobe 60 on the plunger moves away from the upper end portion of the bridge and, as a result, there is no need to provide the switch with a bridge-actuating cam or other member separate from the plunger. Accordingly, the cost of manufacturing and assembling the components of the switch is reduced.

We claim:

1. An electrical switch comprising a housing, a switch actuator comprising an elongated cylindrical plunger molded of plastic and supported by said housing for back and forth linear shifting along a predetermined path between a normal unactuated position and an actuated position to which the plunger may be moved manually, a spring within said housing and urging said plunger toward and releasably holding said plunger in said normal position, first and second spaced electrical terminals in said housing, said first terminal having an elongated section extending generally transversely of said plunger and being inclined at an acute angle relative to said plunger, a conductive bridge made of a single piece of spring metal, said bridge having an intermediate portion fulcrumed on and connected electrically to said elongated and inclined section of said first terminal and having first and second end portions integral with and extending in generally opposite directions from said intermediate portion, said end portions of said bridge being inclined relative to said plunger with said first end portion being oriented in a direction toward said plunger due, at least in part, to said intermediate portion of said bridge being fulcrumed on said elongated and inclined section of said first terminal, a projection molded integrally with and extending generally radially from said plunger and, when said plunger is in said normal position, acting directly on said first end portion of said bridge with a force causing said second end portion of said bridge to be held in a normal position relative to said second terminal, and said projection moving away from said first end portion of said bridge as said plunger is shifted linearly along said path toward said actuated position thereby to permit said first end portion of said bridge to move generally transversely of said path and cause said bridge to snap over center with a spring action and move said second end portion of said bridge to an actuated position relative to said second terminal.

2. A switch as defined in claim 1 in which said elongated section of said first terminal is inclined in such a direction as to diverge away from said projection when said plunger is in said normal position and as said elongated section progresses toward said plunger.

3. A switch as defined in claim 1 in which said housing also is molded of plastic and includes two opposing side walls, aligned lugs molded integrally with and projecting inwardly from said side walls and positioned to engage and stop said first end portion of said bridge after said bridge has snapped over center, said lugs having opposing ends spaced from one another and defining a gap through which said projection moves as said plunger is shifted between its normal and actuated positions.

4. An electrical switch comprising a housing, a switch actuator supported by said housing for back and forth linear shifting along a predetermined path between a normal unactuated position and an actuated position to which the actuator may be moved manually, a spring within said housing and urging said actuator toward and releasably holding said actuator in said normal position, first and second spaced electrical terminals in said housing, said first terminal having an elongated section extending generally transversely of said plunger and being inclined at an acute angle relative to said plunger, a conductive bridge made of a single piece of resiliently yieldable spring metal, said bridge having an intermediate portion fulcrumed on and connected electrically to said elongated and inclined section of said first terminal and having first and second end portions integral with and extending in generally opposite directions from said intermediate portion, said end portions of said bridge being inclined relative to said plunger with said first end portion being oriented in a direction toward said plunger due, at least in part, to said intermediate portion of said bridge being fulcrumed on said elongated and inclined section of said first terminal, holding means joined rigidly to said actuator and, when said actuator is in said normal position, acting directly on said first end portion of said bridge with a force causing said second end portion of said bridge to be held in a normal position relative to said second terminal, said first end portion of said bridge being biased directly against said means by virtue of the resiliency of said spring metal when said actuator is in said normal position, and said means moving away from said first end portion of said bridge as said actuator is shifted linearly along said path toward said actuated position thereby to permit said first end portion of said bridge to move generally transversely of said path and enable said bridge to snap over center by virtue of the resiliency of said spring metal and move said second end portion of said bridge to an actuated position relative to said second terminal.

5. A switch as defined in claim 4 in which said elongated section of said first terminal is inclined in such a direction as to diverge away from said means when said actuator is in said normal position and as said elongated section progresses toward said plunger.

6. A switch as defined in claim 4 in which said holding actuator comprises an elongated cylindrical plunger molded of plastic, said means comprising a projection molded integrally with and extending generally radially from said plunger.

7. A switch as defined in claim 6 in which said housing also is molded of plastic and includes two opposing side walls, aligned lugs molded integrally with and projecting inwardly from said side walls and positioned to engage and stop said first end portion of said bridge after said bridge has snapped over center, said lugs having opposing ends spaced from one another and defining a gap through which said projection moves as said actuator is shifted between its normal and actuated positions.

8. An electrical switch comprising a housing molded of plastic and having two opposing side walls, a switch actuator comprising an elongated cylindrical plunger molded of plastic and supported by said housing for back and forth linear shifting along a predetermined path between a normal unactuated position and an actuated position to which the plunger may be moved manually, a spring within said housing and urging said plunger toward and releasably holding said plunger in said normal position, first and second spaced electrical terminals in said housing, a conductive bridge made of spring metal, said bridge having an intermediate portion fulcrumed on and connected electrically to said first terminal and having first and second end portions extending in generally opposite directions from said intermediate portion, a projection molded integrally with and extending generally radially from said plunger and, when said plunger is in said normal position, acting on said first end portion of said bridge with a force causing said second end portion of said bridge to be held in a normal position relative to said second terminal, said projection moving away from said first end portion of said bridge as said plunger is shifted linearly along said path toward said actuated position thereby to permit said first end portion of said bridge to move generally transversely of said path and cause said bridge to snap over center with a spring action and move said second end portion of said bridge to an actuated position relative to said second terminal, aligned lugs molded integrally with and projecting inwardly from said side walls and positioned to engage and stop said first end portion of said bridge after said bridge has snapped over center, said lugs having opposing ends spaced from one another and defining a gap through which said projection moves as said plunger is shifted between its normal and actuated positions.

* * * * *